US006663545B2

(12) United States Patent
Wilson

(10) Patent No.: US 6,663,545 B2
(45) Date of Patent: Dec. 16, 2003

(54) PORTABLE AND MULTI-PURPOSE EXERCISE DEVICE

(76) Inventor: Jack D. Wilson, EP3923 County Rd. E, Stratford, WI (US) 54484

( * ) Notice: Subject to any disclaimer, the term of this patent is extended or adjusted under 35 U.S.C. 154(b) by 235 days.

(21) Appl. No.: 09/827,674

(22) Filed: Apr. 6, 2001

(65) Prior Publication Data

US 2002/0147083 A1 Oct. 10, 2002

(51) Int. Cl.[7] ..... A63B 23/00
(52) U.S. Cl. ..... 482/139; 482/11; 601/38
(58) Field of Search ..... 482/49, 127, 10, 482/11, 139; 601/38, 23

(56) References Cited

U.S. PATENT DOCUMENTS 1,714,029 A * 5/1929 Kuhn ..... 482/11
1,851,865 A * 3/1932 Ptacek ..... 482/11
4,280,696 A * 7/1981 Ramon ..... 482/11
5,582,560 A * 12/1996 Magnuson ..... 482/111

* cited by examiner

*Primary Examiner*—Glenn E. Richman
(74) *Attorney, Agent, or Firm*—Quarles & Brady LLP

(57) ABSTRACT

The present invention is an exercise device comprising a flexor and a board. The present invention is also an exercise device comprising a flexor and an insert. The flexor has two arms, each of which has an end. The corresponding ends, one from each arm, are apart and the two arms are resistant to forces that tend to bring the corresponding flexible ends closer to each other. The board can be attached to one of the arms of the flexor. In another embodiment, the board can be attached to one of the arms of the flexor at different positions to provide different levels of resistance. The insert can stay between the two arms of the flexor and provide additional resistance to forces that tend to bring the corresponding ends of the two arms closer to each other.

9 Claims, 4 Drawing Sheets

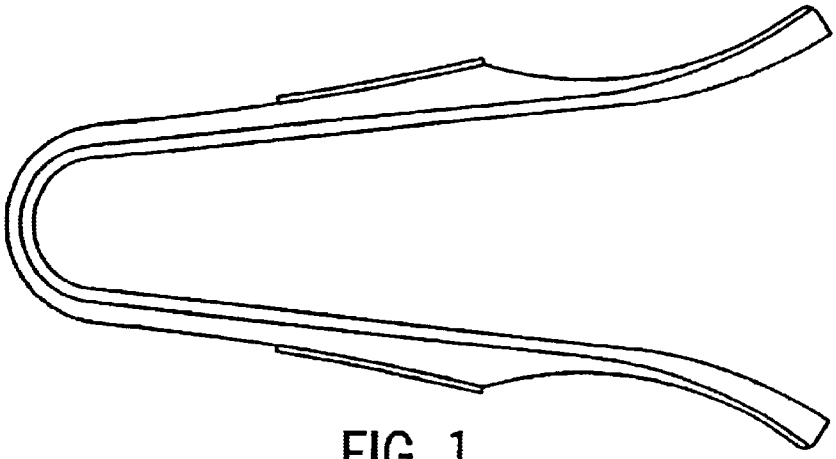
FIG. 1
(PRIOR ART)
FIG. 2
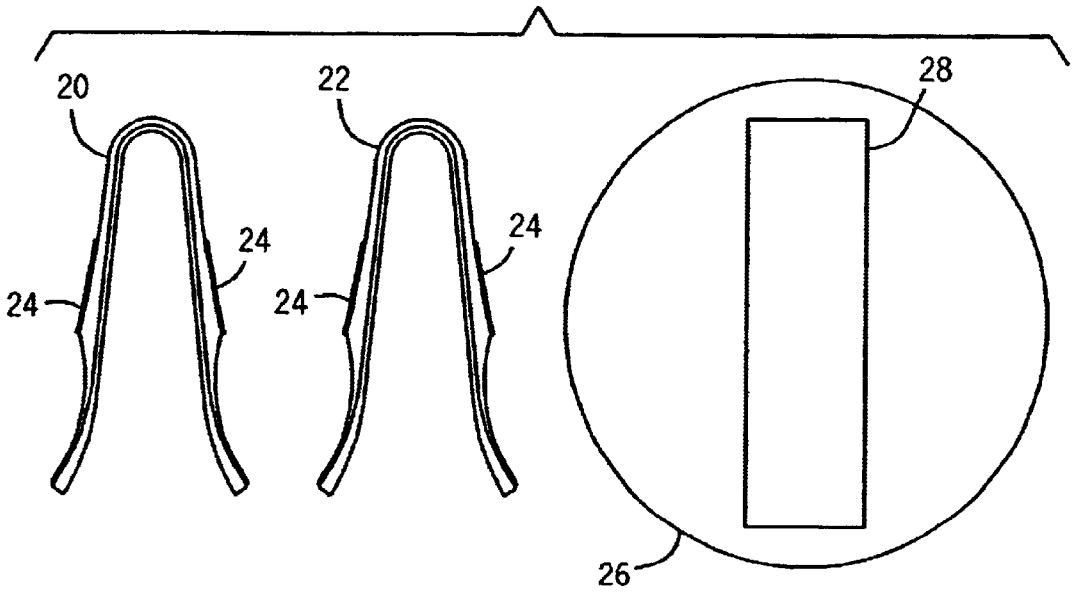

PORTABLE AND MULTI-PURPOSE EXERCISE DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to the field of portable, multi-purpose exercise devices. As people become more aware of the health benefits of proper exercise and fitness, the amount of commercial activity directed toward developing and marketing convenient and attractive ways to exercise has increased dramatically. Many types and categories of home exercise devices are currently marketed and sold directly to consumers for use in their own homes. Some of these devices are large mechanical manufactures that are intended to provide a gym-type environment in the home for doing exercise. Some exercise devices are smaller portable devices, typically intended to provide a mechanism to exercise a particular body part of muscle group.

One type of small portable exercise device is marketed under the trademark Funflexor™. The Funflexor exercise device is an integrally formed molded plastic product, that has been on the market. FIG. 1 is an illustration of this device. The Funflexor exercise device 10 has two arms 12 and 14 connected to each other in a V-shape formation by a hinge section 16. The Funflexor device 10 is made of a resin and fiberglass selected such that the characteristics of the resin and the thickness of the hinge section 16 determine the amount of force which must be exerted on the arms 12 and 14 to bend the device at the hinge section 16. The two arms of a Funflexor device are thus resistant to the forces exerted on them to bring them closer to each other, and the amount of the resistance is dependent on the thickness of the hinge section 16 and the choice of the material for the device. The Funflexor device is intended to be used for many flexibility and muscle toning exercises.

BRIEF SUMMARY OF THE INVENTION

The present invention is an exercise device or kit including at least one flexor device and a board. The flexor is an integrally molded exercise device which has two arms, which can be flexed under muscle pressure toward each other. The board can be attached to one of the arms of the flexor as a recipient of a force that tends to bring the two arms closer to each other. In another embodiment, the board can be attached to one of the arms of the flexor at different positions to provide different levels of resistance to forces that tend to bring the corresponding arms closer to each other.

The present invention is also an exercise device comprising a flexor and an insert. The flexor is as described above. The insert can stay between the two arms of the flexor and provide more resistance to forces that tend to bring the corresponding flexible ends of the two arms closer to each other.

In another embodiment of the present invention, the exercise device comprises a flexor, a board and an insert, each of which is as described above.

It is an object of the present invention to provide a portable, multi-purpose exercise device with a larger surface upon which a body part can contact in using the device for exercise.

It is another object of the present invention to provide a portable, multi-purpose exercise device with adjustable resistance.

It is an advantage of the present invention that the exercise device with adjustable resistance has a wide resistance range.

Further objects, features and advantages of the invention will be apparent from the following detailed description when taken in conjunction with the accompanying claims and drawings.

BRIEF DESCRIPTION OF THE SEVERAL VIEWS OF THE DRAWINGS

FIG. 1 shows a flexor device in the prior art.

FIG. 2 illustrates the exercise device kit in accordance with the present invention.

DETAILED DESCRIPTION OF THE INVENTION

Figure 3:
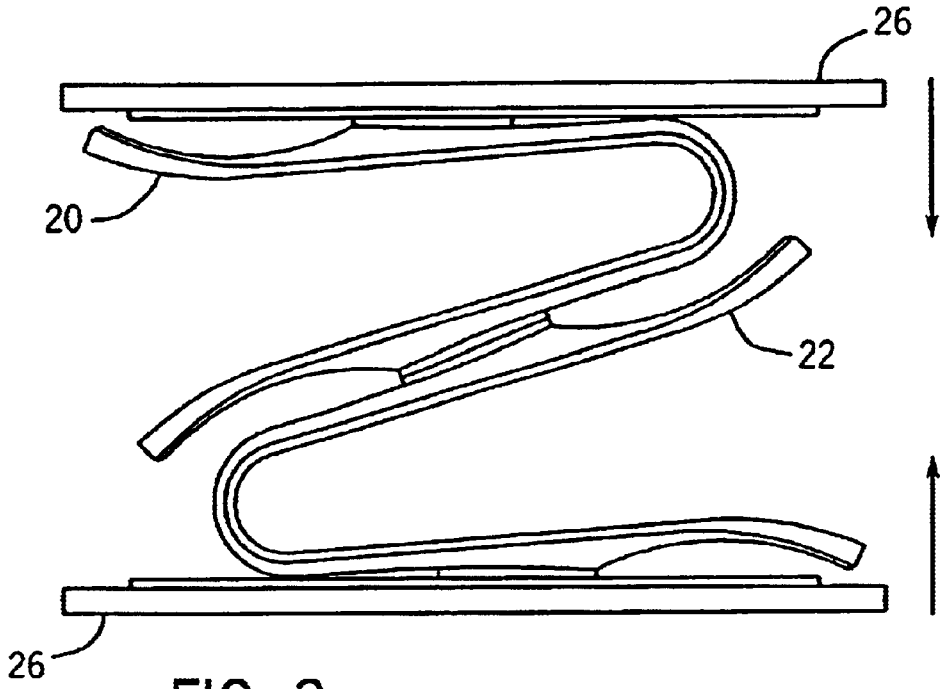
FIG. 3 illustrates one configuration of the use of the kit of FIG. 2.

The present invention is an exercise device or kit including at least one flexor device and a board. The flexor is an integrally molded exercise device which has two arms, which can be flexed under muscle pressure toward each other. The Funflexor device is one preferred embodiment of such a flexor, but it is contemplated that other flexing devices could also be used in this invention. In the flexor as it sits at rest, the corresponding ends of the two arms are some distance apart from each other. Under the physical muscle pressure applied by a human user of the flexor, the two arms of the flexor can move toward each other. The amount of force necessary to flex the flexor depends on the rigidity of the material from which the flexor is made, the thickness of the hinge portion or segment of the flexor, and the length of the arms of the flexor. In fact, flexors of varying resistance can be made by adjusting these parameters. This invention is directed toward making the use of such an integrally constructed flexor device, such as the Funflexor, more adaptable in its use to a wider variety of exercises and muscle groups.

While the invention here is described in terms of an exercise device, that term is intended to be used expansively. One of the intended uses for the exercise kit of the present invention is physical therapy of hurt or wounded joints or extremities. The exercise kit may be used by sports medicine physicians to design exercises specifically intended to rehabilitate specific muscles or joints from injury or disease. Of course, general exercise use for basic physical fitness and body development is also an intended use of the kit.

FIG. 2 illustrates one embodiment of the present invention. The exercise device kit illustrated in FIG. 2 includes two flexors, designated 20 and 22. The flexors 20 and 22 are generally similar to the flexor 10 except for the provision for an attachment member 24 located on the exterior of each arm of each flexor. The attachment member can be any manner of physical attachment mechanism that permits easy and efficient attachment and detachment of the attachment members from each other. Preferably and conveniently, the attachment members 24 are pads of statistical fastener material, such as the product sol under the trademark Velcro. The statistical type fastener, also sometimes called hook and loop fasteners, easily grasp and adhere to a similar fastener, but can be removed from attachment to the opposed fastener by a level of force that ah person can readily exert. The kit of FIG. 2 also includes a leverage board 26, which has an elongated attachment member 28 located on one of its surfaces. The leverage board is illustrated as the preferred embodiment of a circular disk, but the leverage board may also be of any convenient geometric shape. What is important, for reasons that will become apparent, is that the leverage board have a significant length in at least one direction and that the attachment member 28 be elongated in that direction. The kit may optionally include more than one leverage board 26 and more than two of the flexors.

The important feature of a leverage board for the present invention is that it provides a larger surface area than an arm of the flexor for a body part to contact in using the exercise device of the present invention to exercise. The materials used to build a board are not critical. The exact shape of a board is not critical either. A board can be in a simple flat round shape or in a shape that conforms to a body part that contacts the board.

The inclusion of the attachment members on the flexors, together with the inclusion of the leverage board 26, makes the exercise device a much more flexible and adaptable device that when a simple flexor is used by itself. The use of multiple components, i.e. flexors and boards, together with the ability to releasably attach those components together, enables an exercise device which can be altered to adapt to multiple exercises for multiple body parts and also enables the device to vary the resistance exerted by the exercise device during its use. Some examples will illustrate this adaptability.

In FIG. 3, the exercise device kit includes two flexors 20 and 22 and two of the leverage boards 26. The flexors 20 and 22 are located in between the boards 26, with the flexors oriented in opposite directions. Because the flexors are oriented in opposite directions, the angular spreads of the arms of the two flexors are complementary and the boards 26 on the top and bottom of the stack are parallel. The attachment member of the lower board 26 attaches to the attachment member 24 on the lower arm of the lower flexor 22. The attachment member 24 on the upper arm of the lower flexor 22 attaches to the attachment member 24 on the lower arm of the upper flexor 20, while the attachment member 24 on the upper arm of the upper flexor 20 attaches to the attachment member on the upper board 26. In this configuration, the flexors act in combination to add their resistive force, and the motion of the exercise is linear, inward and outward, as indicated in FIG. 2. This exercise might, for example, be used by a relatively fit younger person for arm strengthening by pressing the two boards 26 together with hands.

Figure 4:
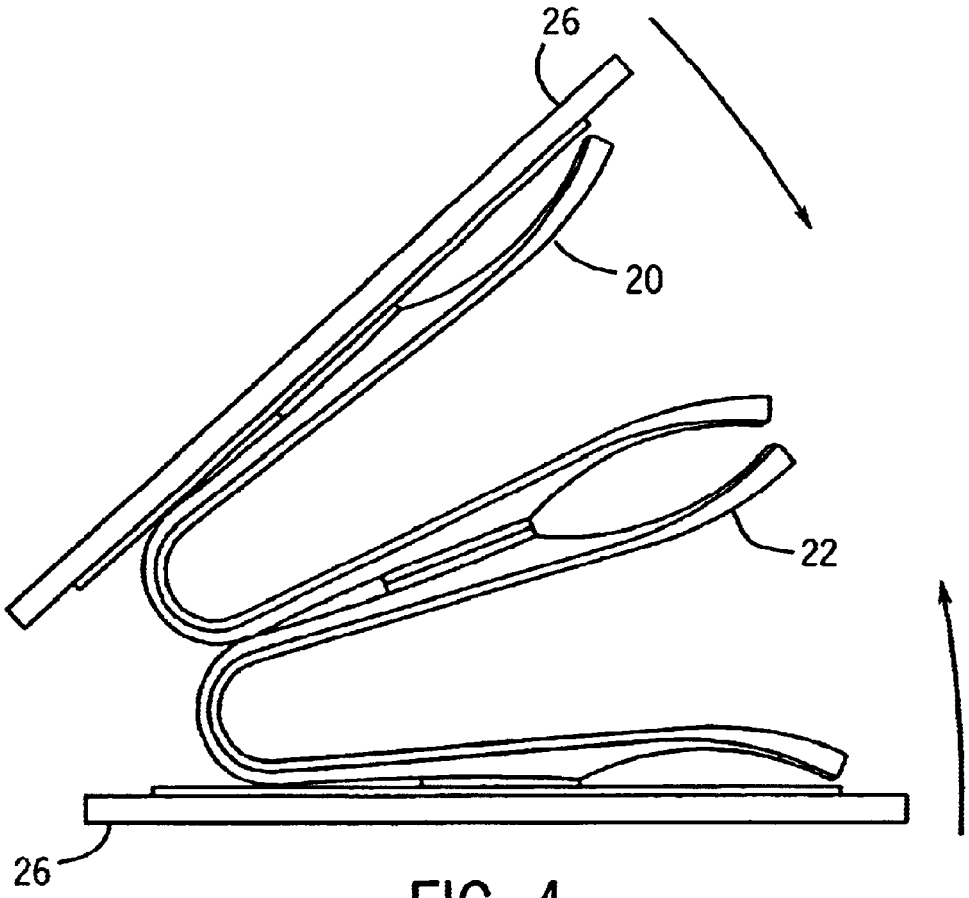
FIG. 4 illustrates another configuration of the use of the kit of FIG. 2.

Shown in FIG. 4 is another configuration for the use of the exercise device kit of the invention. In the configuration of FIG. 4, there are two flexors and two boards, as in FIG. 3, the difference being that in FIG. 4 the flexors are oriented in the same direction rather than opposite directions. When oriented in this way, the spread of the arms of the two flexors are additive rather than cancelling and thus the two boards 26 are angled apart from each other at rest by the combined spread angle of the two flexors. When used in this fashion, the exercise kit is suitable for exercising a bending joint, such as an ankle, or any other joint which moves in a pivoting motion. This exercise is one that is particularly adapted for people who are rehabilitating an ankle from injury or surgery.

Figure 5:
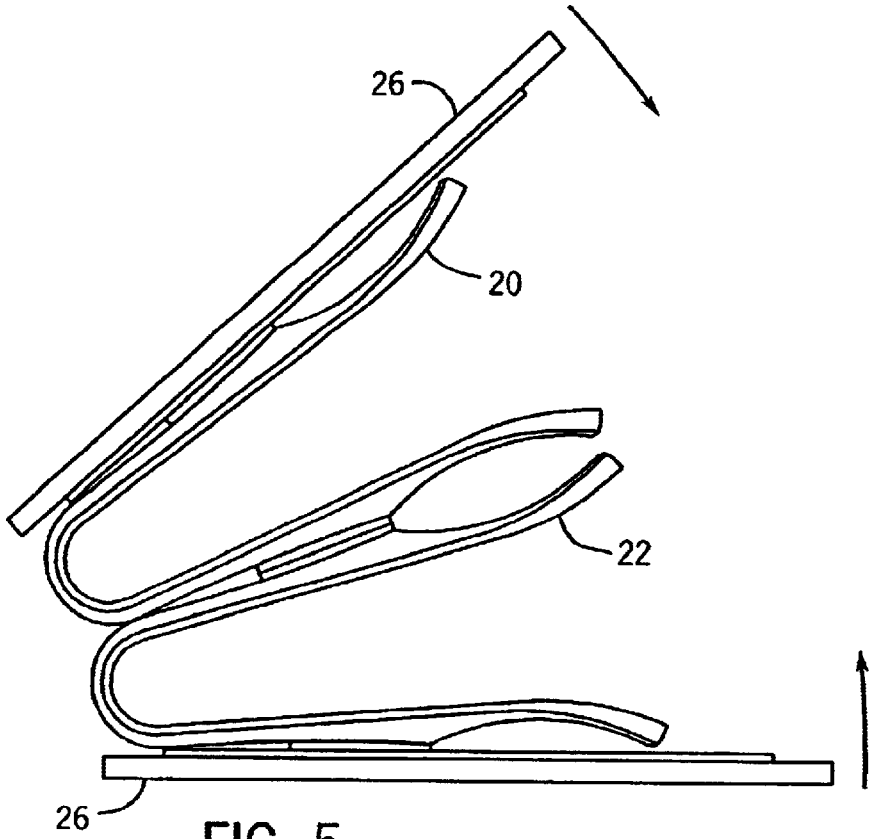
FIGS. 5 and 6 illustrate two comparable but distinct configurations of the use of the kit of FIG. 2.
Figure 6:
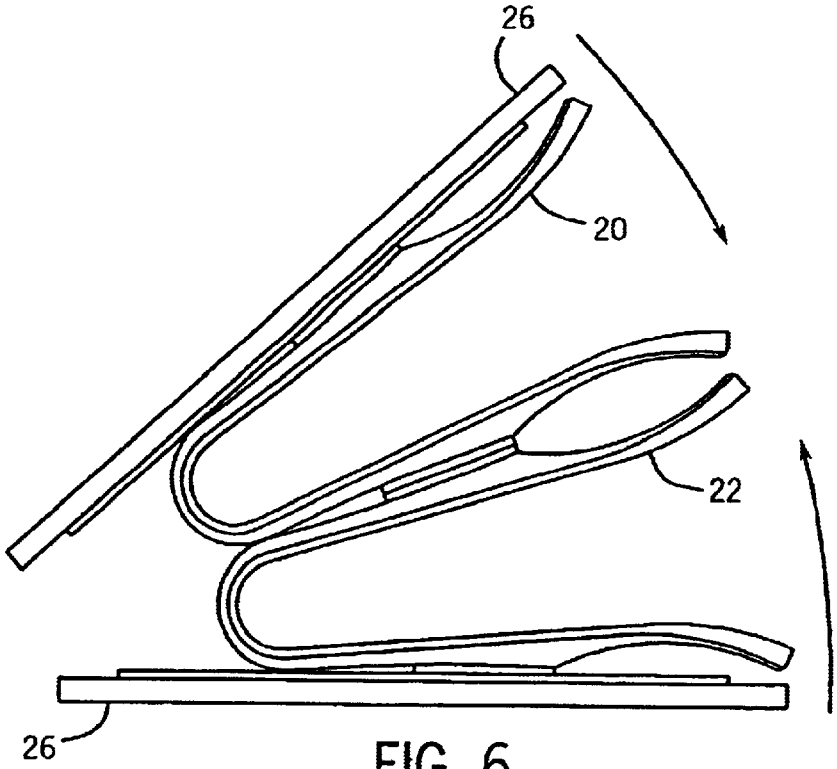

Another feature of the flexibility of the exercise device kit of the present invention is illustrated by a comparison of FIGS. 5 and 6. In each of the configurations of the device as shown in these figures, the two flexors and the boards are oriented generally as they are in FIG. 4. The significant different between the configuration of FIG. 5 and that of FIG. 6 has to do with the location of the attachment between the two flexors 20 and 22 and the boards 26. As stated above, the attachment members 28 on the boards 26 are elongated in at least on dimension. This permits the flexors 20 and 22 to be attached to the respective boards 26 at any physical location along the length of the boards 26. Note that the difference between the configuration of FIG. 5 and that of FIG. 6 is where the flexors are attached to the boards. In FIG. 5, assuming that the person is doing an ankle exercise and that the person's heel is to the left, the flexors are attached to the boards close to the person's heel. In contrast, in FIG. 6, the configuration is the same but the flexors are attached closer to the user's toes. The performance difference in these two configurations is in the amount of force needed to move the combined device. In the configuration of FIG. 6, the leverage provided by the leverage boards 26 is large, i.e. the moment arm on the lever is longer, and the device is relatively easy to flex. In the configuration of FIG. 5, the leverage provided by the leverage boards is relatively small, because the moment arm of the lever is smaller, and the device is significantly harder to flex. The attachments of the flexors to the leverage boards is continuously variable between the configurations of FIGS. 5 and 6 and thus the amount of force needed to use the device is continuously variable as well.

Figure 7:
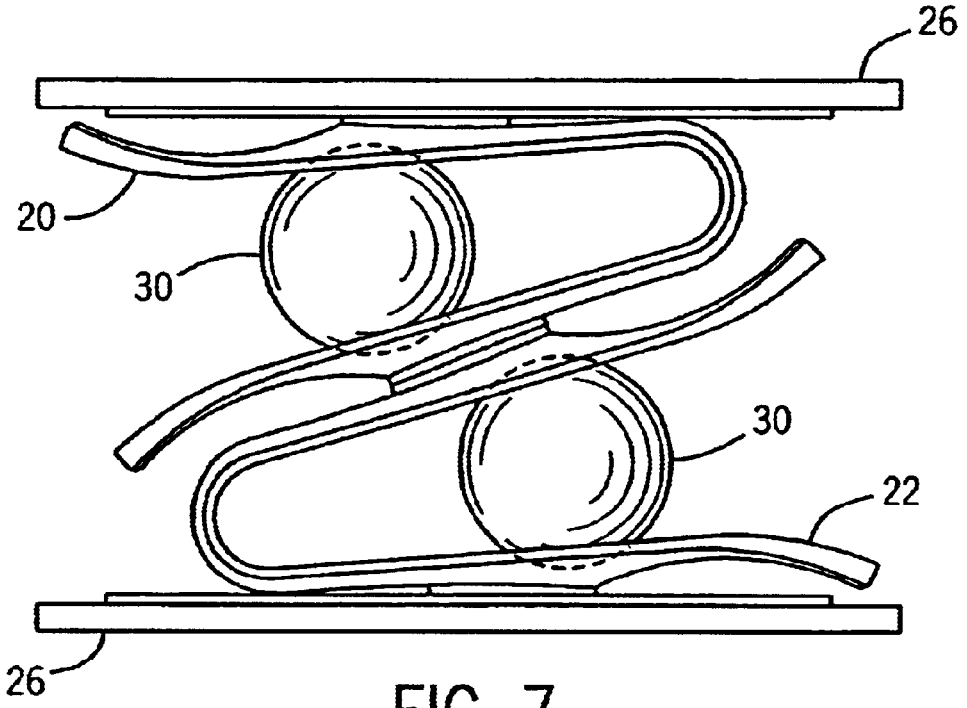
FIG. 7 illustrates another option in the use of the kit of FIG. 2.

The exercise device kit of this invention includes on more optional feature as well. On the inside surface of each arm of the flexors, a concave cavity is provided. The purpose of this cavity is illustrated by the configuration of FIG. 7. In FIG. 7, in addition to two of the flexors designated 20 and 22, there are two balls, each designated 30. The two balls 30 are resilient spherical balls which are compressible with some force. A preferred choice for the balls 30 are the common racquet ball. The balls 30 are tucked in between the arms of the each of the flexors such that the calls are captured in between the cavities under the arms. Then, as the exercise device is used, the balls 30 add to the resistance against compression as the exercise device is flexed by the user. The amount of additional resistive force added by each such ball 30 is actually quite large, so only one ball may be needed by many users. This again permits the device to be flexible used to increase the amount of muscle force required for particular exercises. It is also envisioned that multiple balls of varied compressive strength can be used to provide additional variation in the exercises which may be performed with the kit of the present invention. It would also be possible to substitute a compression spring for the ball to achieve a similar result.

The exercise devices of the present invention can provide full range of motions of ankle, wrist and shoulder as the arms of the flexor are compressed, or compressed and rotated. The devices can be used in physical therapy, or usual muscle toning and strengthening exercises. The combination of the two flexors with either one or two of the boards make for a kit that permits a wide variety of exercises to be performed with varying requirements for physical force. In this way a convenient and flexible kit is made possible for both exercise and physical therapy uses.

In the above description, the present invention is described in connection with specific and preferred embodiments. It will be understood that the present invention is not limited to these embodiments, but rather is to be construed to be of spirit and scope defined by the appended claims.

I claim:

1. An exercise device kit, comprising:

at least two flexors, each flexor comprising two arms, each of which has an end, and a hinge portion joining the arms, such that the hinge portion resists movements of the two arms toward each other;

an attachment member on the exterior of each flexor, each attachment member releasably attachable to similar attachment members; and at least one board with an attachment member compatible with the attachment member on the flexors, so that the board can be attached to one of the arms of one of the flexors so that the arrangement of the flexors and the location of the attachment between the board and the flexors permits variations in type of exercise and the necessary force exerted in use of the device.

2. The exercise device of claim 1, wherein the board can be attached to one of the arms of the flexor at more than one position to provide different levels of resistance to forces exerted on the board for bringing corresponding flexible ends of the two arms closer to each other.

3. The exercise device of claim 1, wherein the board is round in shape.

4. The exercise device of claim 1, further comprising:

an insert that stays between the two arms of the flexor, the insert provides additional resistance to forces that tend to bring the corresponding flexible ends of the two arms closer to each other.

5. The exercise device of claim 4, wherein the insert is a ball.

6. The exercise device of claim 4, wherein the insert is a spring.

7. The exercise device of claim 1, further comprising:

a second board that can be attached to one of the arms of the flexor as a recipient of a force that tends to bring the corresponding ends of the two arms closer to each other.

8. The exercise device of claim 7, wherein the second board can be attached to one of the arms of the flexor at more than one position to provide different levels of resistance to forces exerted on the second board for bringing the corresponding flexible ends of the two arms closer to each other.

9. An exercise device comprising:

a flexor comprising two arms, each of which has at least one end, the corresponding ends of the two arms being at rest spaced apart from each other and the two arms being resistant to forces that tend to bring the ends closer to each other; and an insert that stays between the two arms of the flexor, the insert provides additional resistance to forces that tend to bring the corresponding ends of the two arms closer to each other, the insert being a resilient spherical ball.

* * * * *